US005388734A

United States Patent [19]

Seitz

[11] Patent Number: 5,388,734

[45] Date of Patent: Feb. 14, 1995

[54] GARMENT HANGER SHOULDER GUARD WITH SIMULATED BOW-TIE ORNAMENTAL DEVICE

[75] Inventor: Joel N. Seitz, Parsippany, N.J.

[73] Assignee: P.D.S. Product Development Corp., South Hackensack, N.J.

[21] Appl. No.: 247,529

[22] Filed: May 23, 1994

Related U.S. Application Data

[63] Continuation of Ser. No. 155,682, Nov. 22, 1993, abandoned.

[51] Int. Cl.[6] ..... A41D 27/22

[52] U.S. Cl. ..... 223/98; 223/87

[58] Field of Search ..... 223/85, 87, 98, DIG. 1; 2/154, 151; 206/300

[56] References Cited

U.S. PATENT DOCUMENTS

| | | | |
|---|---|---|---|
| 239,657 | 4/1881 | Hellenberg | 223/87 |
| 1,638,375 | 8/1927 | Stutz . | |
| 1,665,983 | 4/1928 | Rose . | |
| 2,013,570 | 9/1935 | Markowitz | 223/87 |
| 2,025,291 | 12/1935 | Linney . | |
| 2,106,947 | 2/1938 | Hamilton et al. . | |
| 2,147,590 | 2/1939 | Adkins . | |
| 2,301,403 | 11/1942 | Hirsch . | |
| 2,649,229 | 8/1953 | Sutter . | |
| 3,096,009 | 7/1963 | Jang | 223/87 |
| 3,162,341 | 12/1964 | Strampe . | |
| 3,285,481 | 11/1966 | Zintel . | |
| 3,378,180 | 4/1968 | Singer | 223/87 |
| 3,705,653 | 12/1972 | Pereyra | 223/87 |
| 5,224,893 | 7/1993 | Franz | 446/321 |

*Primary Examiner*—Clifford D. Crowder
*Assistant Examiner*—Bibhu Mohanty
*Attorney, Agent, or Firm*—Samuelson & Jacob

[57] ABSTRACT

A shoulder guard for a wire hanger is erected from a flat blank of card stock and includes a contour configuration complementary to a jacket to be hung on the hanger so that the jacket is draped appropriately over the shoulder guard, and an ornamental device in the form of a simulated bow-tie is placed on the shoulder guard so as to be located between the lapels of the jacket, when the jacket is hung on the hanger and draped over the shoulder guard, to provide an aesthetically pleasing appearance, the relative contour configurations of the simulated bow-tie and the shoulder guard being such that the simulated bow-tie stands out in visible relief from the shoulder guard in response to erection of the shoulder guard.

12 Claims, 3 Drawing Sheets

GARMENT HANGER SHOULDER GUARD WITH SIMULATED BOW-TIE ORNAMENTAL DEVICE

This application is a continuation of application Ser. No. 08/155,682, filed Nov. 22, 1993 now abandoned.

The present invention relates generally to shoulder guards used in connection with garment hangers and pertains, more specifically, to a garment hanger shoulder guard having an ornamental device providing an aesthetically pleasing appearance when viewed with a garment hung upon the garment hanger.

Garment hangers constructed of wire have become the most widely accepted garment hangers for use in connection with handling garments in dry cleaning establishments. Shoulder guards constructed of flat card stock are utilized in connection with such hangers almost universally to protect garments against wrinkling and other distortion while hung upon the hangers. These shoulder guards usually are supplied to dry cleaning establishments in a flat configuration, separate from the garment hangers, and must be erected and assembled with the hangers. Once erected, the shoulder guard provides a contour configuration essentially complementary to the portion of the garment draped over the hanger, enabling the garment to be draped over the wire hanger free of wrinkles and distortion.

The present invention provides an aesthetic touch to the otherwise ordinary shoulder guard and, as such, attains several objects and advantages, some of which are summarized as follows: Places an aesthetically pleasing ornamental device for view in connection with a garment on a hanger for added appeal in the use of shoulder guards; enables the appropriate placement and display of an ornamental device in the form of a simulated bow-tie without requiring additional material over and above the material employed in a conventional shoulder guard; enables the appropriate placement and display of a simulated bow-tie ornament on a shoulder guard without requiring additional erection and assembly operations; automatically displays an ornamental device, in the form of a simulated bow-tie, in a predetermined location on a shoulder guard in response to erection of the shoulder guard; provides an economical adjunct to conventional shoulder guards, capable of use in connection with a wide variety of shoulder guard constructions and configurations, for added appeal in the use of shoulder guards; enables economical manufacture in large quantities of uniform high quality and added aesthetic appeal.

The above objects and advantages, as well as further objects and advantages, are attained by the present invention which may be described briefly as providing an ornamental device in a shoulder guard for a garment hanger, the shoulder guard being of the type erected from an essentially flat sheet of material to include a front panel contoured to complement essentially a garment to be hung on the hanger, the garment having an opening placed at a predetermined location along the front panel when the garment is hung on the hanger and draped over the shoulder guard, the ornamental device being in the form of a simulated bow-tie integral with the front panel at the predetermined location, the ornamental device comprising: a visible representation of a bow-tie knot at the predetermined location along the front panel, the representation of the bow-tie knot including opposite sides; a visible representation of a bow-tie wing extending from each of the opposite sides of the bow-tie knot representation, each bow-tie wing representation having a wing-like configuration extending from a wing root located at the representation of the bow-tie knot to an opposite wing tip, and a perimetric boundary outlining the configuration of each respective bow-tie wing representation; a slit in the front panel extending along the perimetric boundary of each wing representation, at least adjacent each wing tip, such that upon erection of the shoulder guard each wing representation is separated from the portion of the front panel along the slit thereby enabling each wing representation to follow a wing contour separate from and standing away from the portion of the front panel along the slit, whereby the ornamental device is viewable in relief against the remainder of the front panel of the shoulder guard, at the predetermined location within the opening of the garment.

The invention will be understood more fully, while still further objects and advantages will become apparent, in the following detailed description of a preferred embodiment of the invention illustrated in the accompanying drawing, in which.

Figure 1:
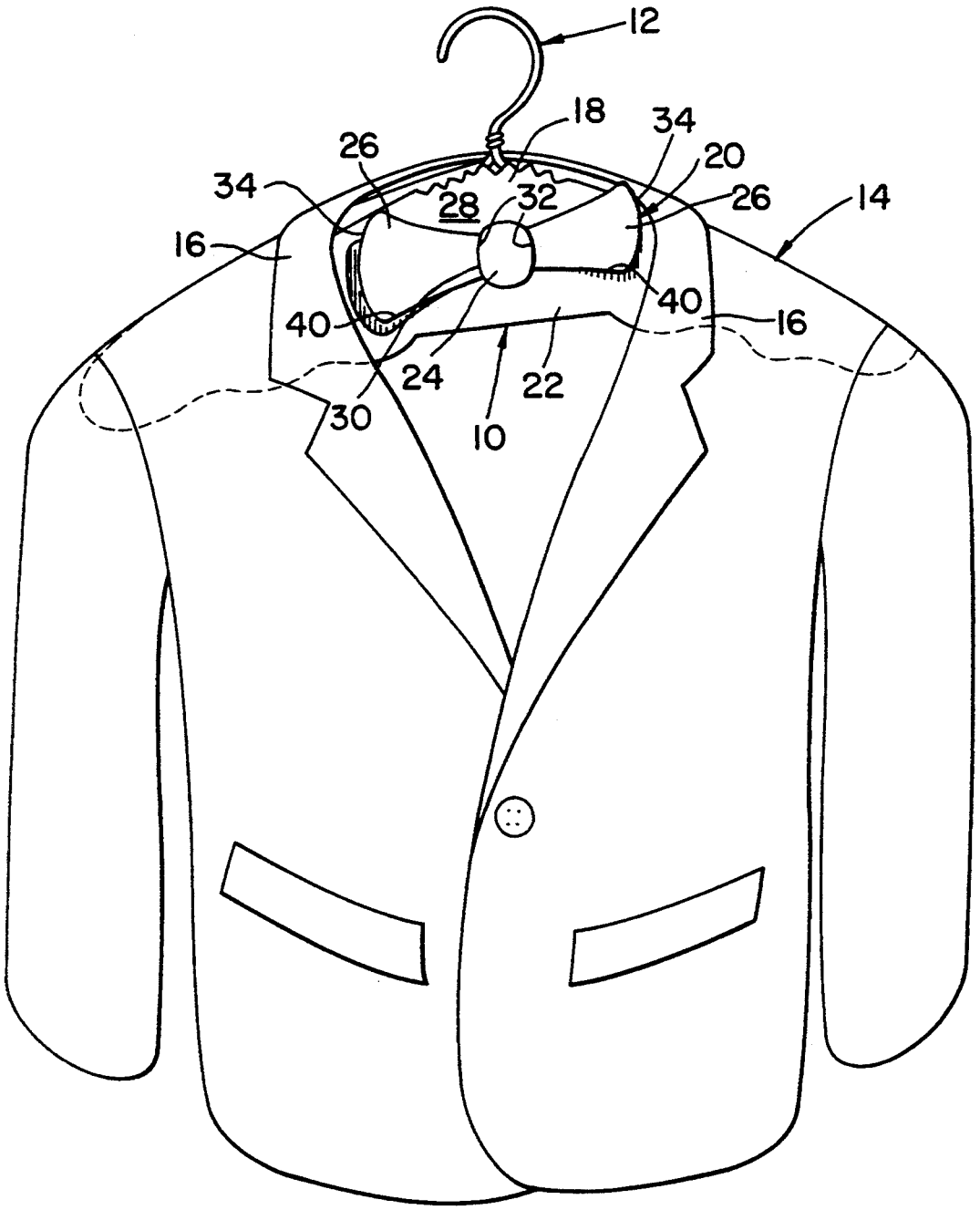
FIG. 1 is a left side, front pictorial view of a shoulder guard constructed in accordance with the invention and placed upon a wire hanger, with a garment hung on the hanger and draped over the shoulder guard.

Referring now to the drawing, and especially to FIG. 1 thereof, a shoulder guard constructed in accordance with the invention is illustrated at 10 and is seen to be assembled with a wire hanger 12 so as to provide protection to a garment, shown in the form of a men's jacket 14 hung on the hanger 12 and draped over the shoulder guard 10. Jacket 14 is of a conventional style having lapels 16 placed at either side of an opening 18 between the lapels 16 of the jacket 14. The shoulder guard 10 assures that the jacket 14 is draped appropriately to protect against wrinkling and other distortion while the garment is hung on the hanger 12.

In order to provide an aesthetically appealing appearance, an ornamental device in the form of a simulated bow-tie 20 is placed at a predetermined location in the front panel 22 of the shoulder guard 10 for placement within the opening 18 so as to be viewed in connection with the jacket 14. Simulated bow-tie 20 includes a simulated bow-tie knot in the form of a visible representation of a knot 24 and simulated bow-tie wings in the form of visible representations of wings 26 extending outwardly from the knot 24 to complete a visible simulation of a bow-tie placed within the opening 18 between the lapels 16 of jacket 14. The front panel 22 of the shoulder guard 10 has a front surface 28 which follows a surface contour, in this instance the surface contour being a convex, curved contour, to essentially complement the configuration of the jacket 14 draped over the shoulder guard 10.

In the illustrated preferred embodiment, the simulated bow-tie 20 is visible in raised relief relative to the front surface 28 of front panel 22. To this end, knot 24 includes a debossed line 30 extending along the periphery of the knot 24, and the wings 26 extend outwardly from respective wing roots 32 at the knot 24 to respective wing tips 34. Opposite edges 36 (see FIG. 2) extend along the wings 26, from each wing root 32 to each wing tip 34, and a slit 40 in the front panel 22 extends along the perimetric boundary of each wing 26, at least adjacent each wing tip 34, so that the relative contours of the wings 26 and the front surface 28 of the front panel 22 at the slits 40 enables the wings 26 to stand away from the portion of the front surface 28 of the front panel 22 along the slits 40 so that the simulated bow-tie 20 is viewable in relief against the remainder of the front panel 22 at the opening 18.

Figure 2:
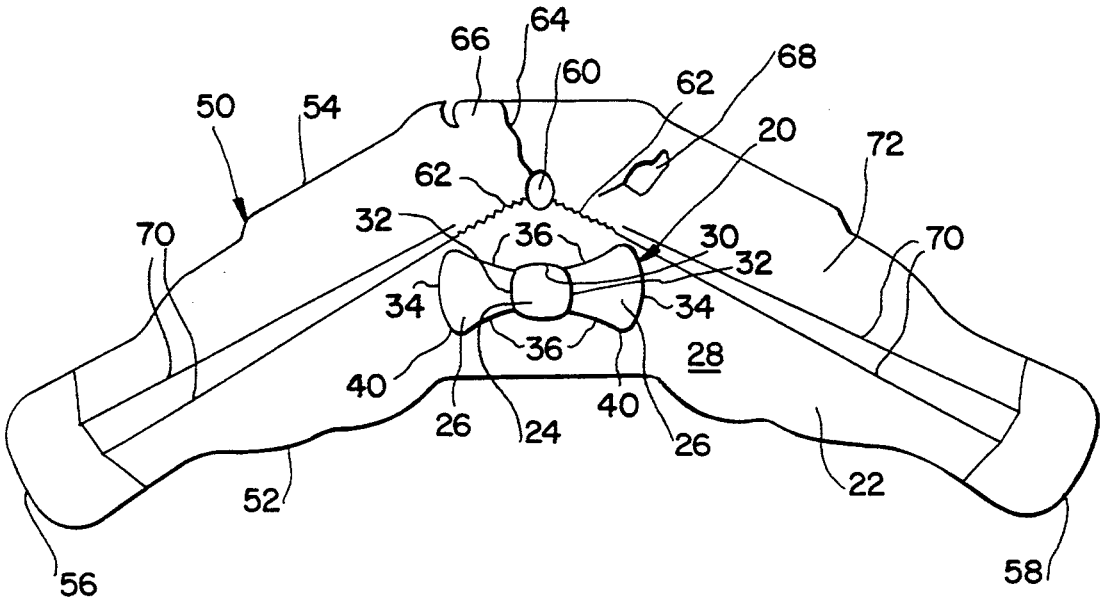
FIG. 2 is a top plan view of a blank from which the shoulder guard of the present invention is erected.

Turning now to FIG. 2, shoulder guard 10 is constructed from a sheet of material in the form of card stock cut to form a flat blank 50 which is to be erected for assembly with the wire hanger 12. Blank 50 includes a front edge 52, a rear edge 54 and opposite ends 56 and 58. An aperture 60 is placed intermediate the front edge 52 and the rear edge 54, centrally between the opposite ends 56 and 58 and cuts 62 in the blank 50 communicate with the aperture 60 for facilitating assembly with the hanger 12 after the blank 50 is erected, as will be explained below. A further cut 64 extends from the aperture 60 to the rear edge 54 and a tab 66 is established adjacent the further cut 64, the tab 66 being placed between the further cut 64 and the end 56. A slot 68 is located between the further cut 64 and the end 58. Fold lines 70 extend along the blank 50 intermediate the front edge 52 and the rear edge 54, between the aperture 60 and the opposite ends 56 and 58, and delimit the front panel 22, which extends between the fold lines 70 and the front edge 52, as well as a rear panel 72. The simulated bow-tie 20 is shown in a latent form, with the knot 24 defined by the debossed line 30 in the front panel 22 and the wings 26 defined by slits 40 which pass through the card stock along the perimetric boundaries of the wings 26.

Figure 3:
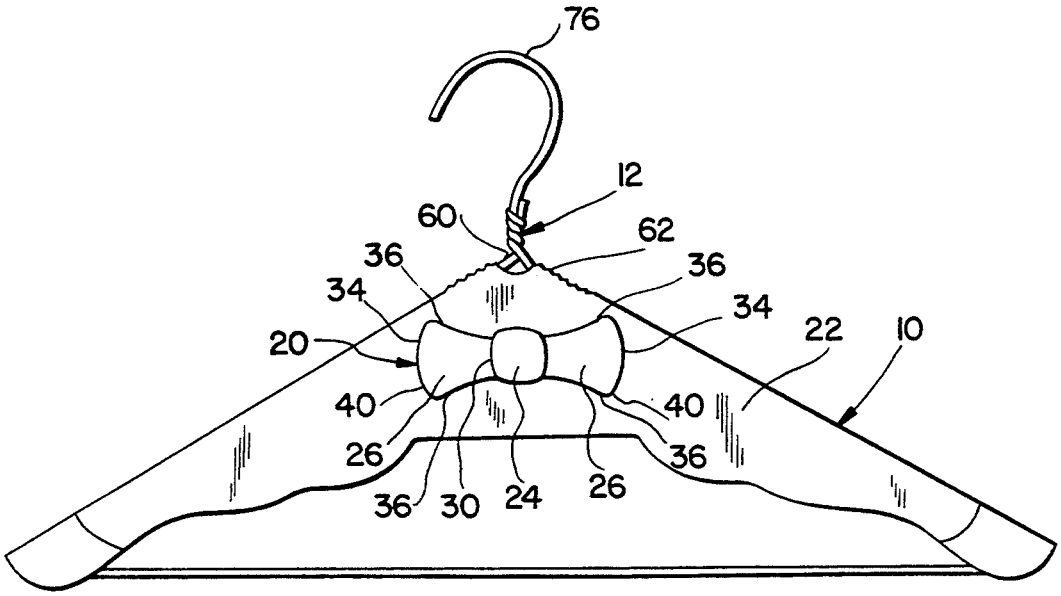
FIG. 3 is a front elevational view of the shoulder guard erected and assembled with a wire hanger.
Figure 4:
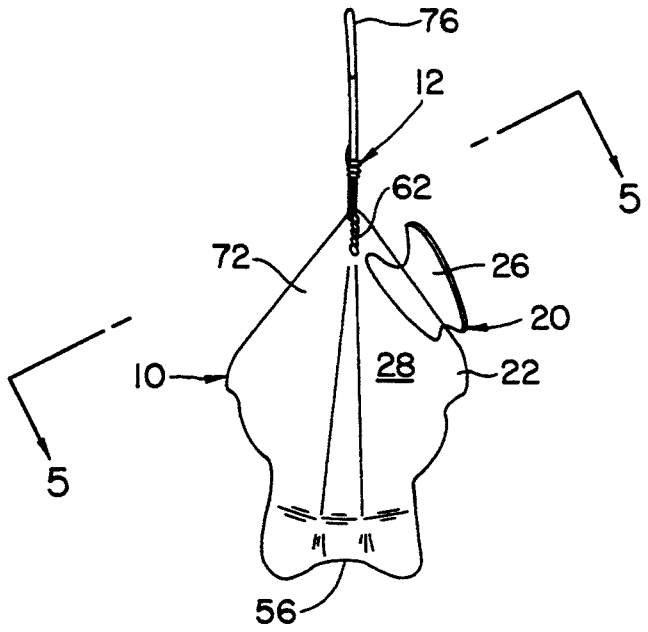
FIG. 4 is an end elevational view of the left end of the shoulder guard and hanger assembly.
Figure 5:
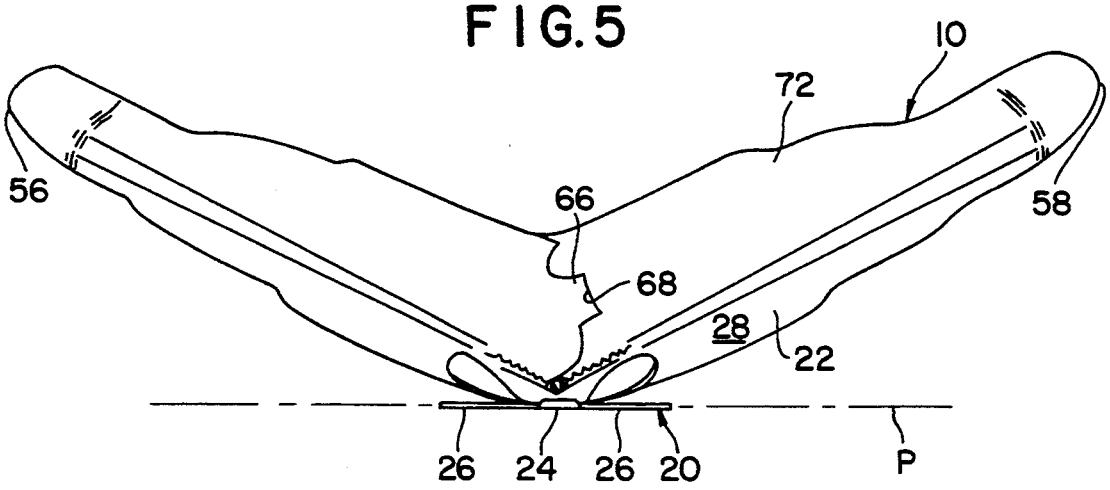
FIG. 5 is a top plan view of the shoulder guard and hanger assembly, taken along line 5—5 of FIG. 4.

Upon erection of the shoulder guard 10 for assembly with the wire hanger 12, as seen in FIGS. 3 through 5, as well as in FIG. 1, the blank 50 is folded along fold lines 70 to shape the shoulder guard 10 so that the front panel 22 and the rear panel 72 are contoured generally complementary to the jacket 14, enabling the jacket 14 to be draped over the shoulder guard 10 when the jacket 14 is hung upon the hanger 12, in a now well-known manner. To that end, the front panel 22 and the rear panel 72 take on a generally convex, curved configuration. The tab 66 is inserted into the slot 68 to maintain the shoulder guard 10 in the erected configuration, and the hook 76 of the wire hanger 12 is passed through the aperture 60 and the communicating cuts 62 to assemble the shoulder guard 10 with the wire hanger 12.

As the front panel 22 is drawn into the convex configuration, during erection of the shoulder guard 10, the construction of the simulated bow-tie 20, and especially the slits 40 thereof, causes the wings 26 to remain generally flat and planar, while the surrounding front surface 28 of the front panel 22 follows the convex contour configuration, so that the latent simulated bow-tie 20 emerges from the front panel 22 and stands out in visible relief from the remainder of the front panel 22 in response to erection of the shoulder guard 10. Thus, as best seen in FIGS. 4 and 5, the wings 26 lie generally in a plane P which extends in front of the front panel 22 and, as a result, are separate from and stand out from the front panel 22 to be viewable in relief. No operation other than the erection of the shoulder guard 10 in the conventional manner is required to attain that result.

Accordingly, an attractive, aesthetically pleasing touch is added to the shoulder guard 10 with very little by way of additional expense and without the need for additional operations or special tools or skills in the erection of the shoulder guard 10 and assembly with the wire hanger 12.

It will be seen that the present invention attains the several objects and advantages summarized above, namely: Places an aesthetically pleasing ornamental device for view in connection with a garment on a hanger for added appeal in the use of shoulder guards; enables the appropriate placement and display of an ornamental device in the form of a simulated bow-tie without requiring additional material over and above the material employed in a conventional shoulder guard; enables the appropriate placement and display of a simulated bow-tie ornament on a shoulder guard without requiring additional erection and assembly operations; automatically displays an ornamental device, in the form of a simulated bow-tie, in a predetermined location on a shoulder guard in response to erection of the shoulder guard; provides an economical adjunct to conventional shoulder guards, capable of use in connection with a wide variety of shoulder guard constructions and configurations, for added appeal in the use of shoulder guards; enables economical manufacture in large quantities of uniform high quality and added aesthetic appeal.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a shoulder guard for a garment hanger, the shoulder guard being of the type erected from an essentially flat sheet of material to include a front panel contoured to complement essentially a garment to be hung on the hanger, the garment having an opening placed at a predetermined location along the front panel when the garment is hung on the hanger and draped over the shoulder guard, an ornamental device in the form of a simulated bow-tie integral with the front panel at the predetermined location, the ornamental device comprising:

a visible representation of a bow-tie knot at the predetermined location along the front panel, the representation of the bow-tie knot including opposite sides;

a visible representation of a bow-tie wing extending from each of the opposite sides of the bow-tie knot representation, each bow-tie wing representation having a wing-like configuration extending from a wing root located at the representation of the bow-tie knot to an opposite wing tip, and a perimetric boundary outlining the configuration of each respective bow-tie wing representation;

a slit in the front panel extending along the perimetric boundary of each wing representation, at least adjacent each wing tip, such that upon erection of the shoulder guard each wing representation is separated from the portion of the front panel along the slit thereby enabling each wing representation to follow a wing contour separate from and standing away from the portion of the front panel along the slit, whereby the ornamental device is viewable in relief against the remainder of the front panel of the shoulder guard, at the predetermined location within the opening of the garment.

2. The invention of claim 1 wherein the front panel includes a contoured front surface and the wing representations of the simulated bow-tie ornamental device are essentially flat, relative to the contoured front surface of the front panel.

3. The invention of claim 2 wherein the contoured front surface has a convex configuration and the wing representations essentially follow a plane extending in front of the front panel.

4. The invention of claim 1 wherein each wing representation includes opposite edges extending from the wing root to the wing tip, and each slit extends along essentially the entire perimetric boundary of a respective wing representation, from the wing root to the wing tip along one of the opposite edges, and from the wing tip to the wing root along the other of the opposite edges.

5. The invention of claim 1 wherein the bow-tie knot representation has a perimeter extending around the bow-tie knot representation and includes a debossed line in the front panel along the perimeter of the bow-tie knot representation, the debossed line extending at least between the bow-tie knot representation and each respective wing representation.

6. The invention of claim 5 wherein the debossed line extends along essentially the entire perimeter of the bow-tie knot representation.

7. The invention of claim 1 wherein the relative contours of the front panel and the wing representations are such that the wing representations are separated from the portions of the front panel along the slits in response to erection of the shoulder guard.

8. The invention of claim 7 wherein the front panel includes a contoured front surface and the wing representations of the simulated bow-tie ornamental device are essentially flat, relative to the contoured front surface of the front panel.

9. The invention of claim 8 wherein the contoured front surface has a convex configuration and the wing representations essentially follow a plane extending in front of the front panel.

10. The invention of claim 9 wherein each wing representation includes opposite edges extending from the wing root to the wing tip, and each slit extends along essentially the entire perimetric boundary of a respective wing representation, from the wing root to the wing tip along one of the opposite edges, and from the wing tip to the wing root along the other of the opposite edges.

11. The invention of claim 10 wherein the bow-tie knot representation has a perimeter extending around the bow-tie knot representation and includes a debossed line in the front panel along the perimeter of the bow-tie knot representation, the debossed line extending at least between the bow-tie knot representation of each respective wing representation, from one to the other of the opposite edges of each wing representation.

12. The invention of claim 11 wherein the debossed line extends along essentially the entire perimeter of the bow-tie knot representation.

* * * * *